United States Patent [19]

Hattori et al.

[11] Patent Number: 5,077,184

[45] Date of Patent: Dec. 31, 1991

[54] SILVER HALIDE PHOTOGRAPHIC MATERIAL CONTAINING COLOR REVERSIBLE DYE LAYER

[75] Inventors: Yasushi Hattori, Kanagawa; Koichi Suematsu, Shizuoka; Shigeru Ohno, Kanagawa, all of Japan

[73] Assignee: Fuji Photo Film Co., Ltd., Kanagawa, Japan

[21] Appl. No.: 641,962

[22] Filed: Jan. 16, 1991

[30] Foreign Application Priority Data

Jan. 16, 1990 [JP] Japan ..... 2-6801

[51] Int. Cl.[5] ..... G03C 1/34

[52] U.S. Cl. ..... 430/510; 430/513

[58] Field of Search ..... 430/510, 513

[56] References Cited

U.S. PATENT DOCUMENTS 4,326,162 3/1983 Kawata et al. ..... 430/513

4,695,531 9/1987 Delfino et al. ..... 430/513

*Primary Examiner*—Jack P. Brammer

*Attorney, Agent, or Firm*—Sughrue, Mion, Zinn, Macpeak & Seas

[57] ABSTRACT

A silver halide photographic material comprising a support provided with an undercoat layer and having thereon at least one silver halide emulsion layer and at least one dye-containing hydrophilic colloid layer between the emulsion layer and the undercoat layer, wherein the dye contained in the dye-containing hydrophilic colloid layer absorbs light in the light-sensitive region of the silver halide emulsion layer and is decolorized during the course of development, the dye-containing hydrophilic colloid layer has a swelling ratio of not higher than 180%; the coating weight of the hydrophilic colloid of the dye-containing hydrophilic colloid layer is not more than 0.5 g/m$^2$; the undercoat layer comprises a hydrophobic polymer, and at least on hydrophilic colloid layer is provided between the dye-containing hydrophilic colloid layer and the undercoat layer.

11 Claims, No Drawings

SILVER HALIDE PHOTOGRAPHIC MATERIAL CONTAINING COLOR REVERSIBLE DYE LAYER

FIELD OF THE INVENTION

The present invention relates to a silver halide photographic material, and more particularly, to a silver halide photographic material having an extremely thin hydrophilic colloid layer containing a dye.

BACKGROUND OF THE INVENTION

In silver halide photographic materials, photographic emulsion layers or other layers are often colored to allow light in a specific wavelength region to be absorbed.

Generally, a colored layer is provided between a photographic emulsion layer and a support or on the surface side of the support which is opposite to the photographic emulsion layer, to prevent fuzziness. That is, the colored layer prevents halation from being caused by light that is scattered when incident light is passed through photographic emulsion layers or after incident light is transmitted through it. The light is reflected at the interface between the emulsion layer and the support, or reflected on the surface which is opposite to the emulsion layer, and the reflected light enters the photographic emulsion layers again. Such a colored layer is called an antihalation layer.

In X-ray photographic materials, a colored layer, which functions as a crossover cut filter, is sometimes provided to improve sharpness by reducing crossover light.

The layers to be colored generally comprise a hydrophilic colloid. Dyes are generally incorporated into the layers to color them. It is necessary that the dyes meet the following requirements.

(1) The dyes have proper spectral absorption according to the intended use.

(2) The dyes are inactive photographically and chemically. Specifically, the dyes do not have any adverse effect on the performance of silver halide photographic emulsion layers in a chemical sense. For example, they do not cause a lowering in sensitivity, a degradation of latent images or fogging.

(3) The dyes are decolorized or removed by dissolution during the course of development so that no harmful color is left on the photographic materials after processing.

However, when the colored layer such as the antihalation layer or the crossover cut layer is formed by using a hydrophilic colloid, there is a disadvantage in that the volume of the water-permeable layers is increased and, as a result, drying characteristics during development are deteriorated.

In order to solve this problem, a dye is fixed to a layer, which is used to improve the adhesion between the hydrophilic colloid layer and the support. (The layer which plays a role in bonding the support to the hydrophilic colloid layer is referred to herein as the undercoat layer.) Methods for fixing dyes into the undercoat layer include a method wherein a dye is allowed to be adsorbed by a mordant as described in U.S. Pat. Nos. 4,957,856 and 4,965,180 and Japanese Patent Application No. 62-224447, a method wherein a dye dissolved in oil as oil droplets is emulsified and dispersed as described in Japanese Patent Application No. 1-142688, a method wherein a dye is adsorbed on the surface of an inorganic material as described in Japanese Patent Application No. 1-139691, a method wherein a dye is adsorbed by a polymer as described in Japanese Patent Application No. 1-119851 and a method wherein a dye in the form of a solid is dispersed as described in U.S. Pat. Nos. 4,803,150 and 4,900,652 and Japanese Patent Application No. 1-87367.

It is disclosed in the examples of these patent specifications that an undercoating polymer layer used for the undercoat layer and a dye layer are coated so as to be brought into contact with each other. Such a coating has a disadvantage in that the dye is introduced into the undercoating polymer and is left as a residual color after development.

It is believed that the dye enters into the gaps of the undercoating polymer and is confined in the polymer during the drying of the dye layer, whereby the residual color is formed.

SUMMARY OF THE INVENTION

An object of the present invention is to provide a silver halide photographic material having an antihalation layer or a crossover cut layer which scarcely forms residual color without increasing the amount of hydrophilic colloid.

The above-described object of the present invention has been achieved by providing a silver halide photographic material comprising a support containing an undercoat layer, having thereon at least one silver halide emulsion layer (hereinafter referred to as emulsion layer) and at least one dye-containing hydrophilic colloid layer (hereinafter referred to as dye layer) between the emulsion layer and the undercoat layer, wherein the dye contained in the dye layer absorbs light in the light-sensitive region of the silver halide emulsion layer and is decolorized during the course of development, the dye-containing hydrophilic layer has a swelling ratio of not higher than 180%; the coating weight of the hydrophilic colloid of the dye layer is not less than 0.5 g/m$^2$, the undercoat layer comprises a hydrophobic polymer and at least one hydrophilic colloid layer (hereinafter referred to as interlayer) is provided between the dye layer and the undercoat layer.

DETAILED DESCRIPTION OF THE INVENTION

Examples of the hydrophobic polymer which can be used in the undercoat layer of the present invention include styrene-butadiene copolymers, vinylidene chloride copolymers, water-soluble polyesters and polyacrylic esters. Of these, styrene-butadiene copolymers and vinylidene copolymers are preferred with styrene-butadiene copolymers being more preferred.

The styrene-butadiene copolymers include copolymers of styrene and butadiene of 9/1 to 1/9 and copolymers obtained by using a third comonomer such as acrylic acid, etc.

The coating weight of the hydrophobic polymer of the undercoat layer is preferably from about 100 to about 1,000 mg/m$^2$, and the drying temperature of the undercoat layer is preferably from about 80° to about 200° C.

It is preferred that the hydrophilic polymer used for the undercoat layer is in the form of an aqueous dispersion (latex). Optionally, a crosslinking agent, a surfactant, a swelling agent, a matting agent, an antistatic agent, etc., are added to the aqueous dispersion.

Examples of the crosslinking agent include triazine compounds described in U.S. Pat. Nos. 3,325,287, 3,288,775, and 3,549,377 and Belgian Patent 6,602,226; dialdehyde compounds described in U.S. Pat. Nos. 3,291,624 and 3,232,764, French Patent 1,543,694 and British Patent 1,270,578; epoxy compounds described in U.S. Pat. No. 3,091,537 and JP-B-49-26580 (the term "JP-B" as used herein refers to an "examined Japanese patent publication"); vinyl compounds described in U.S. Pat. No. 3,642,486; aziridine compounds described in U.S. Pat. No. 3,392,024; ethyleneimine compounds described in U.S. Pat. No. 3,549,378; and methylol compounds.

Of these compounds, dichlorotriazine derivatives are preferred.

It is preferred that the interlayer used in the present invention is adjacent to the undercoat layer. A preferred hydrophilic colloid used as a binder for the interlayer is gelatin. However, other hydrophilic colloids such as dextran, polyacrylamide and polyvinyl alcohol can also be used.

A single interlayer, or two or more interlayers may be provided. However, the coating weight of the entire hydrophilic colloid of the interlayers is preferably from about 10 mg/m$^2$ to about 1 g/m$^2$, more preferably 10 to 400 mg/m$^2$, most preferably 10 to 150 mg/m$^2$. The drying temperature is preferably from about 100° to about 200° C.

The interlayer used in the present invention may contain photographic additives such as a hardening agent for gelatin, matting agent, surfactant, antistatic agents, etc. However, the interlayer contains substantially no dye for the purpose of the present invention. Preferably, the dye layer of the present invention is adjacent to the interlayer.

Examples of the dye which can be preferably used in the dye layer of the present invention include dyes described in PCT (WO)88/04794, European Patents 0274,723A1, 276,566 and 299,435, JP-A-52-92716 (the term "JP-A" as used herein refers to a "published unexamined Japanese patent application"), JP-A-55-155350, JP-A-55-155351, JP-A-61-205934, JP-A-48-68623, U.S. Pat. Nos. 2,527,583, 3,486,897, 3,746,539, 3,933,798, 4,130,429 and 4,040,841, Japanese Patent Application Nos. 62-224447, 1-142688, 1-139691, 1-119851 and 1-87367.

These dyes are decolorized during the course of development. That is, the dyes are decolorized and do not leave any harmful residual color in the photographic material after development.

The coating weight of the dye in the dye layer of the present invention is preferably 1 to 1,000 mg/m$^2$, more preferably 10 to 300 mg/m$^2$. The coating weight of the hydrophilic colloid in the dye layer of the present invention is preferably 10 to 500 mg/m$^2$, more preferably 10 to 200 mg/m$^2$. The ratio by weight of the dye to the hydrophilic colloid is preferably at least 0.15, more preferably at least 0.5.

Methods for dispersing the dye include a method wherein the dye is adsorbed by a mordant as described in U.S. Pat. Nos. 4,957,856 and 4,965,180 and Japanese Patent Application No. 62-224447, a method wherein the dye dissolved in oil as oil droplets is emulsified and dispersed as described in Japanese Patent Application No. 1-142688, a method wherein the dye is adsorbed on the surface of an inorganic material as described in Japanese Patent Application No. 1-139691, a method wherein the dye is adsorbed by a polymer as described in Japanese Patent Application No. 1-119851 and a method wherein the dye in the form of a solid is dispersed as described in U.S. Pat. Nos. 4,803,150 and 4,900,652 and Japanese Patent Application No. 1-187367.

In the present invention, the above-described dispersion methods may be used, or other conventional dispersion methods may be used.

The dye-containing layer of the present invention has a swelling ratio of not higher than 180%. The swelling ratio is measured in the following manner.

After a sample is incubated at 38° C. and 50% RH for 3 days, the thickness (a) of the dye layer is measured. Thereafter, the sample is immersed in distilled water at 21° C. for 3 minutes and the thickness (b) of the dye layer is then measured.

$$\text{The swelling ratio} = \frac{(b-a)}{a} \times 100\ (\%)$$

The measurement of the dye layer is made by freezing the dye with liquid nitrogen and observing the cross section thereof through a scanning type electron microscope having a liquid nitrogen stage.

When the swelling ratio of the dye layer of the present invention exceeds 180%, the mar resistance of the sample in processing solutions (developing solutions) is deteriorated.

The swelling ratio of the dye layer of the present invention is preferably in the range of 100 to 180%, more preferably 110 to 170%. The swelling ratio of the dye layer of the present invention can be adjusted to a desired value by controlling the amount of the hardening agent for gelatin. Examples of the hardening agent for gelatin which can be used in the dye layer include chromium salts, aldehydes (e.g., formaldehyde, glutaraldehyde, etc.), N-methylol compounds (e.g., dimethylolurea, etc.), active vinyl compounds (e.g., 1,3,5-triacryloyl-hexahydro-s-triazine, bis(vinylsulfonyl)-methyl ether, N,N'-methylenebis[β-(vinylsulfonyl)propionamide], etc.), active halogen compounds (e.g., 2,4-dichloro-6-hydroxy-s-triazine, etc.), mucohalogenic acids (e.g., mucochloric acid, etc.), N-carbamoylpyridinium salts (e.g., 1-morpholinocarbonyl-3-pyridinio)methane sulfonate, etc.) and haloamidinium salts (e.g., 1-(1-chloro-1-pyridinomethylene)pyrrolidinium, 2-naphthalenesulfonate, etc.). These compounds may be used either alone or in combination. Of these, the active vinyl compounds described in JP-A-53-41220, JP-A-53-57257, JP-A-59-162546 and JP-A-60-80846 and the active halogen compounds described in U.S. Pat. No. 3,325,287 are preferred.

It is preferred that the dye-containing layer of the present invention is dried at a temperature of not lower than 80° C., particularly 80° to 180° C.

Silver halide grains in the emulsion may have a regular crystal form such as cube, octahedron, tetradecahedron or rhombic dodecahedron, an irregular crystal form such as a sphere, plate form or potato form, or a composite of these crystal forms. A mixture of grains having various crystal forms may be used. Tabular grains having a grain size which is at least 5 times the thickness of grain can be preferably used in the present invention (the details of the tabular grains are described in *Research Disclosure*, Vol. 225, Item 22534, pages 20 to 58 (January, 1983), JP-A-58-127921 and JP-A-58-113926).

Sensitive silver halide emulsion used in the present invention may be a mixture of two or more silver halide emulsions. The silver halide emulsions to be mixed with each other may be different in grain size, halogen composition, sensitivity, etc., from each other. A substantially non-sensitive emulsion (the surface or interior thereof may be fogged or not fogged) may be mixed with the sensitive emulsion, or they may be contained in separate layers (the details thereof are described in U.S. Pat. Nos. 2,996,382 and 3,397,987).

For example, a sensitive emulsion comprising a spherical or potato-form grains and a sensitive silver halide emulsion comprising tabular grains having a grain size of at least 5 times the thickness of the grain may be used for the same layer or separate layers as described in JP-A-58-127921. When these emulsions are contained in separate layers, the sensitive silver halide emulsion comprising the tabular grains may be positioned closer to the support or farther away from the support.

The photographic emulsion used in the present invention can be prepared according to the methods described in P. Glafkides, *Chimie et Physique Photographique* (Paul Montel, 1967), G. F. Duffin, *Photographic Emulsion Chemistry* (The Focal Press, 1966), V. L. Zelikman et al., *Making and Coating Photographic Emulsion* (The Focal Press, 1964), JP-A-58-127921 and JP-A-58-113926. Specifically, any of the acid process, the neutral process and the ammonia process can be used.

A soluble silver salt and a soluble halide can be reacted in accordance with the single jet process, the double jet process or a combination thereof. A reverse mixing method can be used in which silver halide grains are formed in the presence of excess silver ion, or a controlled double jet process can be used in which a pAg value in a liquid phase in which silver halide is formed is kept constant. According to this process, a silver halide emulsion comprising silver halide grains in which crystal form is regular and grain size is nearly uniform can be obtained.

The crystal structure of the silver halide grain may be uniform throughout the grain or a laminar structure in which the interior of the grain and the surface thereof are different in crystal structure from each other. The crystal structure may also be a conversion type as described in British Patent 635,841 and U.S. Pat. No. 3,622,318.

Cadmium salt, zinc salt, lead salt, thallium salt, iridium salt or complex salt thereof, rhodium salt or complex salt thereof, or iron salt or complex salt thereof may be present during the course of the formation of the silver halide grains or the physical ripening thereof in the preparation of silver halide.

Solvents for silver halide, such as ammonia, thioether compounds, thiazolidine-2-thione, tetra-substituted ureas, potassium rhodanide, ammonium rhodanide and amine compounds may be present during the formation of the grains to control the growth of the grains.

The silver halide emulsion used in the present invention may be subjected to chemical sensitization or not subjected to chemical sensitization. Conventional chemical sensitization methods such as sulfur sensitization, reduction sensitization or gold sensitization can be used singly or in combination.

Gold sensitization, which is a typical method of noble metal sensitization, uses gold compounds, typically gold complex salts. Noble metals other than gold such as complex salts of platinum, palladium and iridium may also be used. Specific examples thereof are described in U.S. Pat. No. 2,448,060 and British Patent 618,061.

Sulfur sensitizing agents include sulfur compounds contained in gelatin and various other sulfur compounds such as thiosulfates, thioureas, thiazoles and rhodanine.

Reduction sensitizing agents include stannous salts, amines, formamidinesulfinic acids and silane compounds.

The photographic emulsion of the present invention may contain various compounds to prevent fog during the course of preparation of photographic materials or the storage or processing thereof or to stabilize photographic performance. For example, the photographic emulsion may contain various compounds known as anti-fogging agents or stabilizers such as azoles (e.g., benzothiazolium salts, nitroimidazoles, nitrobenzimidazoles, chlorobenzimidazoles, bromobenzimidazoles, nitroindazoles, benzotriazoles, aminotriazoles, etc.); mercapto compounds (e.g., mercaptothiazoles, mercaptobenzothiazoles, mercaptobenzimidazoles, mercaptothiadiazoles, mercaptotetrazoles (particularly, 1-phenyl-5-mercaptotetrazole), mercaptopyrimidines, mercaptotriazines, etc.); thioketo compounds (e.g., oxazolinethione); azaindenes (e.g., triazaindenes, tetraazaindenes (particularly 4-hydroxy-substituted (1,3,3a,7)tetraazaindenes), pentaazaindenes, etc.); and benzenethiosulfonamide, benzenesulfinic acid and benzenesulfonamide.

Particularly, nitron and derivatives thereof described in JP-A-60-76743 and JP-A-60-87322, mercapto compounds described in JP-A-60-80839 and heterocyclic compounds and complex salts of heterocyclic compounds with silver (e.g., 1-phenyl-5-mercaptotetrazole silver) described in JP-A-57-164735 can preferably be used.

The sensitive silver halide emulsion of the present invention may be spectrally sensitized to blue light, green light or red light having a relatively long wavelength or infrared light by using sensitizing dyes. Examples of the sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

The sensitizing dyes may be added at any of the manufacturing stages of the photographic emulsion, or added at any stage just before coating and after the preparation of the emulsion. Examples of the former case include the silver halide grain forming stage, the physical ripening stage and the chemical ripening stage.

The photographic emulsion layer or other hydrophilic colloid layers of the photographic material of the present invention may contain various surfactants as a coating aid or for the purpose of imparting antistatic properties, improving slipperiness, emulsifying, dispersing, improving photographic characteristics (e.g., development acceleration, high contrast, sensitization, etc.) or preventing sticking.

Examples of these surfactants include nonionic surfactants such as saponin (steroid), alkylene oxide derivatives (e.g., polyethylene glycol, polyethylene glycol/polypropylene glycol condensate, polyethylene glycol alkyl ethers, polyethylene glycol alkylaryl ethers, polyethylene oxide adducts of silicone), alkyl esters of saccharose; anionic surfactants such as alkylsulfonates, alkylbenzenesulfonates, alkylnaphthalenesulfonates, alkylsulfuric esters, N-acyl-N-alkyltaurines, sulfosuccinic esters and sulfoalkylpolyoxyethylene alkylphenyl ethers; ampholytic surfactants such as alkylbetaines and alkylsulfobetaines; and cationic surfactants such as aliphatic or aromatic quaternary ammonium salts, pyridinium salts and imidazolium salts. Of these, the surfactants which are particularly preferred include saponin; anions such as Na salt of dodecylbenzenesulfonic acid, di-2-ethylhexyl sodium α-sulfosuccinate, Na salt of p-octylphenoxyethoxyethoxyethanesulfonic acid, Na salt of dodecylsulfuric acid, Na salt of triisopropylnaphthalenesulfonic acid and Na salt of N-methyloleyltaurine; cations such as dodecyltrimethylammonium chloride, N-oleyl-N',N',N'-trimethylammoniodiaminopropane bromide and dodecylpyridium chloride; betaines such as N-dodecyl-N,N-dimethylcarboxybetaine and N-oleyl-N,N-dimethylsulfobutylbetaine; and nonionic surfactants such as poly(average polymerization degree n=10)oxyethylene cetyl ether, poly(n=25)oxyethylene-p-nonylphenol ether and bis(1-poly(n=15)oxyethylene-oxy-2,4-di-t-pentylphenyl).

Preferred examples of the antistatic agent include fluorine-containing surfactants such as K salt of perfluorooctanesulfonic acid, Na salt of N-propyl-N-perfluorooctanesulfonylglycine, Na salt of N-propyl-N-perfluorooctanesulfonylaminoethyloxypoly(n=3)oxyethylenebutanesulfonic acid, N-perfluorooctanesulfonyl-N',N',N'-trimethylammoniodiaminopropane chloride and N-perfluorodecanoylaminopropyl-N',N'-dimethyl-N'-carboxybetaine; nonionic surfactants described in JP-A-60-80848, JP-A-61-112144, JP-A-62-172343 and JP-A-62-173459; and alkali metal nitrates, electrically conductive tin oxide, zinc oxide, vanadium pentoxide and composite oxides obtained by doping these oxides with antimony, etc.

Examples of the matting agent which can be used in the present invention include fine particles of organic compounds such as polymethyl methacrylate homopolymer, copolymer of methyl methacrylate with acrylic acid and starch and fine particles of inorganic compounds such as silica and titanium dioxide. Particle size is preferably about 1.0 to about 10 μm, particularly preferably 2 to 5 μm.

Silicone compounds described in U.S. Pat. Nos. 3,489,576 and 4,047,958, colloidal silica described in JP-B-56-23139, paraffin wax, higher fatty acid esters and starch derivatives can be used as slip agents in the surface layer of the photographic material of the present invention.

Polyols such as trimethylolpropane, pentanediol, butanediol, ethylene glycol and glycerin can be used as plasticizers for the hydrophilic colloid layers of the photographic material of the present invention.

It is preferred that the hydrophilic colloid layers of the photographic material of the present invention contain a polymer latex to improve pressure resistance. Preferred examples of the polymer include homopolymers of alkyl esters of acrylic acid, copolymers of acrylic alkyl esters with acrylic acid, styrene-butadiene copolymer and polymers or copolymers of monomers having an active methylene group.

It is preferred that the hydrophilic colloid layers other than the dye-containing hydrophilic colloid layers are hardened by a hardening agent for gelatin in order to provide a swelling ratio of preferably not higher than about 250%, more preferably not higher than 200% in water when the photographic material of the present invention is used as an X-ray photographic material.

Gelatin can be advantageously used as a binder or protective colloid for the emulsion layer and interlayer of the photographic material of the present invention. However, other hydrophilic colloid can also be used. Examples of other hydrophilic colloid which can be used in the present invention include various synthetic hydrophilic high molecular materials such as homopolymers, for example, dextran, polyvinyl alcohol, polyvinyl alcohol partial acetal, poly-N-vinylpyrrolidone, polyacrylic acid, polyacrylamide and polyvinylimidazole and copolymers thereof.

Lime-processed gelatin, acid-processed gelatin and enzyme-treated gelatin may be used as gelatin. Gelatin hydrolyzate can also be used. Of these, it is preferred that gelatin is used in combination with dextran and polyacrylamide.

Color forming couplers can be added to the emulsion layer of the photographic material of the present invention. Specifically, there can be used compounds which form a color by coupling with aromatic primary amine developing agents (e.g., phenylendiamine derivatives and aminophenol derivatives) in color development. Such compounds include magenta couplers such as 5-pyrazolone couplers, pyrazolobenzimidazole couplers, cyanoacetylcoumarone couplers and open chain acylacetonitrile couplers; yellow couplers such as acylacetamide couplers (e.g., benzoylacetanilides, pivaloylacetanilides, etc.); and cyan couplers such as naphthol couplers and phenol couplers. It is preferred that these couplers are nondiffusing couplers having a hydrophobic group (called a ballast group) in the molecule. The couplers may be any 4-equivalent type or 2-equivalent type for silver ion. The couplers may be any colored couplers having a color correction effect or couplers releasing a development inhibitor with development (called DIR couplers).

In addition to DIR couplers, the emulsion layer may contain non-color forming DIR couplers which release a development inhibitor and produce colorless coupling reaction products.

There is no particular limitation with regard to other constituents of the emulsion layer of the silver halide photographic material of the present invention. If desired, various additives may be used. For example, binders, surfactants, dyes, ultraviolet light absorbers, hardening agents, coating aids, thickeners, etc., described in *Research Disclosure,* Vol. 176, pages 22 to 28 (December, 1978) can be used.

Any conventional method and conventional processing solution described in *Research Disclosure,* No. 176, pages 28 to 30 (RD-17643) can be applied to the photographic processing of the photographic material of the present invention. The photographic processing may be any photographic processing (black-and-white photographic processing) that forms a silver image or photographic processing (color photographic processing) that forms a dye image depending on the intended purpose. Processing temperature is generally in the range of 18° to 50° C.

Developing solutions for use in black-and-white photographic processing may contain conventional developing agents. Examples of the developing agents include dihydroxybenzenes (e.g., hydroquinone), 3-pyrazolidones (e.g., 1-phenyl-3-pyrazolidone) and aminophenols (e.g., N-methyl-p-aminophenol). These developing agents may be used either alone or in combination.

Generally, the developing solutions contain conventional preservatives, alkaline agents, pH buffering agents and antifogging agents. If desired, the developing solutions may optionally contain dissolution aids, color toning agents, development accelerators (e.g., quaternary salts, hydrazine, benzyl alcohol), surfactants, antifoaming agents, water softeners, hardening agents (e.g., glutaraldehyde), tackifiers, etc.

Any conventional development method for forming a positive silver image by known reversal processing can be applied to the photographic material of the present invention. Further, any black-and-white reversal photographic processing development method can be used in the present invention. Conventional processing solutions can be used. Processing temperature is generally in the range of 18° to 65° C. However, a temperature of lower than 18° C. or higher than 65° C. may be used.

Generally, reversal development comprises the following stages.

The first development is followed by rinsing, bleaching, cleaning and whole surface exposure. The second development is followed by fixing, rinsing and drying.

Developing solutions used for the black-and-white photographic processing of the first development may contain conventional developing agents. Examples of the developing agents include dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid and heterocyclic compounds having a condensed ring as formed by the condensation of 1,2,3,4-tetrahydroquinoline ring with indolene ring as described in U.S. Pat. No. 4,067,872. These compounds may be used either alone or in combination. It is particularly preferred that dihydroxybenzenes are used in combination with pyrazolidones and/or aminophenols. Generally, the developing solutions contain conventional preservatives, alkaline agents, pH buffering agents and antifogging agents. If desired, the developing solutions may optionally contain dissolution aids, color toning agents, development accelerators, surfactants, antifoaming agents, water softeners, hardening agents, tackifiers, etc. Generally, the photographic material of the present invention is processed with developing solutions containing a sulfite ion as a preservative in an amount of at least 0.15 mol/-liter.

The pH of the developing solutions is in the range of preferably 9 to 11, particularly preferably 9.5 to 10.5.

The first developing solutions contain a solvent for silver halide, such as NaSCN in an amount of 0.5 to 6 g/liter.

Conventional black-and-white developing solutions can be used as the second developing solutions. Specifically, the second developing solutions have a composition obtained by removing the solvent for silver halide from the first developing solutions. The pH of the second developing solutions is in the range of preferably 9 to 11, particularly preferably 9.5 to 10.5.

The bleaching solutions contain a bleaching agent such as potassium dichromate or cerium sulfate.

The fixing solutions preferably contain thiosulfates and thiocyanates. If desired, the fixing solutions may contain water-soluble aluminum salts.

As a specific type of development, a method may be used wherein the developing agent is incorporated into the photographic material, for example, into the emulsion layer, and the development is carried out by processing the photographic material in an aqueous alkaline solution. Of the developing agents, hydrophobic developing agents can be incorporated into the emulsion layer by various methods described in *Research Disclosure*, No. 169 (RD-16928), U.S. Pat. No. 2,739,890, British Patent 813,253 and West German Patent 1,547,763.

The fixing solutions that have a conventional composition can be used. Examples of fixing agents include thiosulfates, thiocyanates and organosulfur compounds that have an effect as a fixing agent. Fixing solutions may contain water-soluble aluminum salts as hardening agents.

The present invention is now illustrated in greater detail by reference to the following examples which, however, are not to be construed as limiting the invention in any way.

EXAMPLE 1

Preparation of Support 1

A biaxially oriented blue-dyed polyethylene terephthalate film of 175 μm in thickness was subjected to corona discharge treatment. Both sides of the treated film were coated with the following layer in such an amount as to give the following coating weight. The coating was conducted by means of a wire bar coater. The coated film was dried at 175° C. for 1 minute.

| | |
|---|---|
| Butadiene/Styrene Copolymer Latex (butadiene/styrene ratio = 31/69 by weight) | 0.16 g/m$^2$ |
| Sodium Salt of 2,6-Dichloro-6-hydroxy-s-triazine as a hardening agent | 4.2 mg/m$^2$ |

Latex solution contained 0.4 wt % (based on the amount of solid in latex) of the following compound as an emulsifying dispersant.

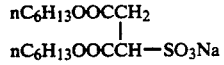

Preparation of Support 2

Both sides of the support 1 were coated with the following layer in such an amount as to give the following coating weight. The coating was carried out by means of a wire bar coater. The coated support was dried at 175° C. for 1 minute.

| | |
|---|---|
| Gelatin | 60 mg/m$^2$ |
| 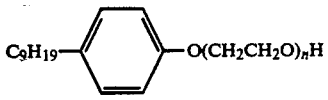 (n = 8.5) (surface active agent) | 0.6 mg/m$^2$ |
| 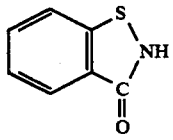 (preservative) | 0.105 mg/m$^2$ |

Preparation of Support 3

The surface of the support 1 was coated with the following layer in such an amount as to give the following coating weight. The coating was carried out by means of a wire bar coater. The coated support was dried at 175° C. for 1 minute.

| | |
|---|---|
| Gelatin | 187 mg/m² |
| 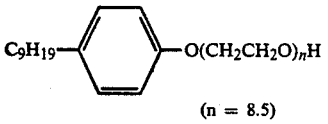 (n = 8.5) | 1.87 mg/m² |
| Matting Agent (polymethyl methacrylate having an average particle size of 2.5 μm) | 2.55 mg/m² |
| 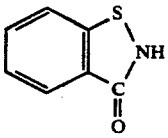 | 0.328 mg/m² |

Support 4

The surface of the support 1 was coated with the following layer in such an amount as to give the following coating weight. The coating was carried out by means of a wire bar coater. The coated support was dried at 175° C. for 1 minute.

| | |
|---|---|
| Gelatin | 187 mg/m² |
| 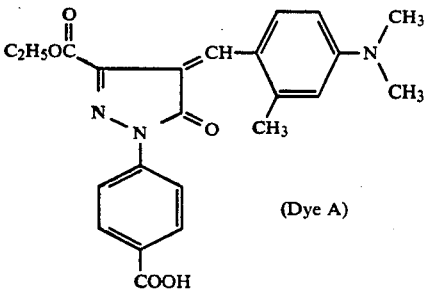 (Dye A) | 100 mg/m² |
| 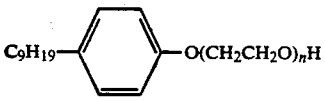 (n = 8.5) | 1.87 mg/m² |
| Matting Agent (polymethyl methacrylate having an average particle size of 2.5 μm) | 2.55 mg/m² |
| 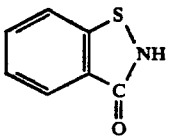 | 0.328 mg/m² |

Support 5

The surface of the support 2 was coated with the following layer in such an amount as to give the following coating weight. The coating was carried out by means of a wire bar coater. The coated support was dried at 175° C. for 1 minute.

| | |
|---|---|
| Gelatin | 500 mg/m² |
| 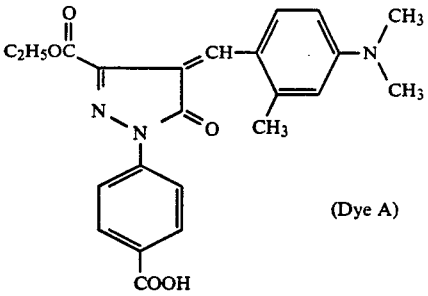 (Dye A) | 100 mg/m² |
| 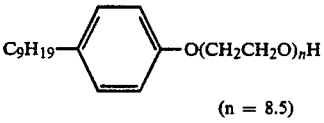 (n = 8.5) | 5 mg/m² |
| Matting Agent (polymethyl methacrylate having an average particle size or 2.5 μm) | 2.55 mg/m² |
| 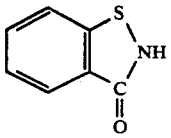 | 0.88 mg/m² |

Support 6

Support 6 was prepared in the same way as in the preparation of the support 4 except that the support 2 was used in place of the support 1 and the amount of gelatin was 127 mg/m².

Preparation of Dye Solution

A dye was previously dissolved in an alkaline solution having a pH of 10.0, and gelatin was added thereto. The pH of the dye solution was adjusted to 5 by using HCl (0.1N).

Preparation of Coating Solution for Emulsion Layer 5 g of potassium bromide, 0.05 g of potassium iodide, 30 g of gelatin and 2.5 cc of a 5% aqueous solution of thioether of $HO(CH_2)_2S(CH_2)_2S(CH_2)_2OH$ were added to 1 liter of water. While keeping the temperature of the resulting solution at 73° C. with stirring, an aqueous solution of 8.33 g of silver nitrate and an aqueous solution containing 5.94 g of potassium bromide and 0.726 g of potassium iodide were added over a period of 45 seconds by means of a double jet process. Subsequently, 2.5 g of potassium bromide was added thereto. Thereafter, an aqueous solution containing 8.33 g of silver nitrate was added over a period of 7.5 minutes at such a rate that the flow rate at the time of the completion of the addition was twice that at the time of the commencement of the addition.

Subsequently, an aqueous solution of 153.34 g of silver nitrate and an aqueous solution of a mixture of potassium bromide and potassium iodide were added over a period of 25 minutes by means of a controlled double jet process while keeping potential at a pAg of 8.1. The flow rate was accelerated so that the flow rate at the time of the completion of the addition was 8 times that at the time of the commencement of the addition.

After the completion of the addition, 15 cc of a 2N potassium thiocyanate solution were added. Further, 50 cc of a 1% aqueous solution of potassium iodide was added over a period of 30 seconds. Thereafter, the temperature was lowered to 35° C. After soluble salts were removed by precipitation, the temperature was raised to 40° C. and 68 g of gelatin, 2 g of phenol and 7.5 g of trimethylolpropane were added. The pH of the mixture was adjusted to 6.55 using sodium hydroxide and the pAg was adjusted to 8.10 using potassium bromide.

After the temperature was raised to 56° C., 175 mg of 4-hydroxy-6-methyl-1,3,3a,7-tetraazaindene and 625 mg of the following sensitizing dye were added. After 10 minutes, 5.5 mg of sodium thiosulfate pentahydrate, 163 mg of potassium thiocyanate and 3.6 mg of chloroauric acid were added. After 5 minutes, the emulsion was quenched to solidify it. The resulting emulsion had a grain size distribution such that grains having an aspect ratio of not lower than 3 accounted for 93% of the sum total of the projected areas of all of the grains. With respect to all grains having an aspect ratio of not lower than 2, the average diameter of projected areas was 0.95 μm, standard deviation was 23%, the average thickness was 0.155 μm and aspect ratio was 6.1.

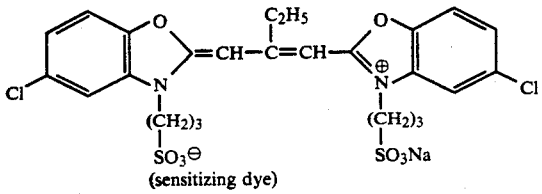

(sensitizing dye)

The following agents per mol of silver halide were added to the emulsion to prepare a coating solution.

| | |
|---|---|
| 2,6-Bis(hydroxyamino)-4-diethylamino-1,3,5-triazine | 80 mg |
| Polysodium Acrylate (average molecular weight: 41,000) | 4.0 g |
| 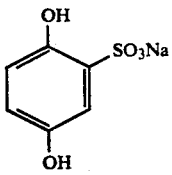 | 9.7 g |
| Ethyl Acrylate/Acrylic Acid/Methacrylic Acid (95/2/3 composition ratio) Copolymer Plasticizer | 20.0 g |
| Nitron | 50 mg |
| 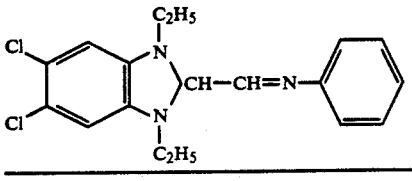 | 5.0 mg |

Preparation of Photographic Materials 1 to 4

Both sides of each of the supports 3 to 6 were coated with the above prepared coating solution for emulsion layer in the same manner to obtain each of photographic materials 1 to 4.

The coating solution for the surface protective layer was prepared by adding the following composition (excluding gelatin) in a 2% aqueous gelatin solution at 40° C.

The coating weights of emulsion layer and surface protective layer per one side were as follows.

Emulsion Layer

| | |
|---|---|
| Coated Amount of Silver | 1.9 g/m$^2$ |
| Coated Amount of Gelatin | 1.5 g/m$^2$ |

Surface Protective Layer

| | |
|---|---|
| Gelatin | 0.81 g/m$^2$ |
| Dextran (average molecular weight: 39,000) | 0.81 g/m$^2$ |
| Polysodium Acrylate (average molecular weight: 41,000) | 70 mg/m$^2$ |

1,2-Bis(sulfonylacetamido)ethane as the hardening agent was coated in such an amount as to give a coating weight of 56 mg/m$^2$ per one side.

| | |
|---|---|
| Matting Agent (average particle size: 3.5 μm, polymethyl acrylate/methacrylic acid (9/1) copolymer) | 0.06 g/m$^2$ |
| $C_8H_{17}$—$C_6H_4$—$O(CH_2CH_2O)_{10}(CH_2CH(OH)CH_2O)_3H$ | 60 mg/m$^2$ |
| $C_8H_{17}$—$C_6H_4$—$O(CH_2CH_2O)_2CH_2CH_2SO_2Na$ | 20 mg/m$^2$ |
| $C_8F_{17}SO_2N(C_3H_7)(CH_2CH_2O)_4(CH_2)_4SO_3Na$ | 2 mg/m$^2$ |
| $C_8F_{17}SO_2N(C_3H_7)(CH_2CH_2O)_{15}H$ | 5 mg/m$^2$ |
| 4-Hydroxy-6-methyl-1,3,3a,7-tetraazaindene | 15.5 mg/m$^2$ |

Evaluation of Photographic Performance

GRENEX ortho screen HR-4 (manufactured by Fuji Photo Film Co., Ltd.) was brought into close contact with both sides of each photographic material by using a cassette for bringing the photographic material into close contact with the screen. X-ray sensitometry was carried out. The adjustment of the exposure amount was made by changing the distance between X-ray bulb and the cassette. After exposure, the photographic materials were processed in an automatic processor by using the following developing solution and fixing solution.

| | |
|---|---|
| Development | 35° C. × 9.5 sec |
| Fixing | 31° C. × 10 sec |
| Rinsing | 15° C. × 6 sec |
| Squeeze | 6 sec |
| Drying | 50° C. × 12 sec |

-continued

| | |
|---|---|
| Dry to Dry Processing Time | 45 sec |

The developing solution and the fixing solution had the following compositions.

| | |
|---|---|
| Potassium Hydroxide | 29 g |
| Potassium Sulfite | 44.2 g |
| Sodium Hydrogencarbonate | 7.5 g |
| Boric Acid | 1.0 g |
| Diethylene Glycol | 12 g |
| Ethylenediaminetetraacetic Acid | 1.7 g |
| 5-Methylbenzotriazole | 0.06 g |
| Hydroquinone | 25 g |
| Glacial Acetic Acid | 18 g |
| Triethylene Glycol | 12 g |
| 5-Nitroindazole | 0.25 g |
| 1-Phenyl-3-pyrazolidone | 2.8 g |
| Glutaraldehyde (50 wt/wt %) | 9.86 g |
| Sodium Metabisulfite | 12.6 g |
| Potassium Bromide | 3.7 g |
| Water to make | 1.0 liter |

Fixing Solution

| | |
|---|---|
| Ammonium Thiosulfate (70 wt/vol %) | 200 ml |
| Disodium Ethylenediaminetetra-acetate Dihydrate | 0.02 g |
| Sodium Sulfite | 15 g |
| Boric Acid | 10 g |
| Sodium Hydroxide | 6.7 g |
| Glacial Acetic Acid | 15 g |
| Aluminum Sulfate | 10 g |
| Sulfuric Acid (36 N) | 3.9 g |
| Water to make | 1 liter |
| pH was adjusted to | 4.25 |

Measurement of Residual Color

After the unexposed film was processed in the above-described processor, the density of green color transmitted light was measured by using X-Rite 310 (densitometer manufactured by The X-Rite Company). The density of green color transmitted light of the blue-dyed polyethylene terephthalate support having no undercoat was measured. A net value obtained by subtracting the resulting value from the above-measured value was referred to as the value of density of residual color. Evaluation was made by the net value.

Measurement of Sharpness (MTF)

MTF (modulation transfer function) was measured by a combination of the above-described HR-4 screen with processing in the automatic processor. Measurement was made by using an aperture of 30 μm×500 μm. Evaluation was made at the part of an optical density of 1.0 by using MTF value in the case where spatial frequency was 1.0 cycle/mm. Details of MTF is described in T. H. James, *The Theory of the Photographic Process*, (1977, Macmillan Publishing Co., Inc.), pp. 592–618.

Measurement of the Swelling Ratio of the Dye Layer

The swelling ratio (%) of the emulsion-coated sample which was not photographically processed was measured 7 days after the sample was coated with the emulsion. The sample was incubated at 38° C. and 50% RH for 3 days among said 7 days. The thickness of the emulsion layer was first measured and each sample was then immersed in distilled water at 21° C. for 3 minutes. A change in the thickness of the emulsion layer was measured.

The measurement of the thickness was made by freezing the sample with liquid $N_2$ and observing the cross section thereof through a scanning type electron microscope having a liquid $N_2$ stage. All samples had a swelling ratio of 150%.

Evaluation of Drying Characteristics

Drying characteristics were evaluated in the following manner when the samples were processed with the above-described automatic processor.

TABLE 1

| Sample | Support Used | Gelatin Interlayer | Crossover (%) | MTF | Residual Color | Dry Characteristics* |
|---|---|---|---|---|---|---|
| Photographic Material-1 (Comparison) | Support 3 | Omitted | 30 | 0.52 | 0.03 | ∘ |
| Photographic Material-2 (Comparison) | Support 4 | Omitted | 2 | 0.71 | 0.10 | ∘ |
| Photographic Material-3 (Comparison) | Support 5 | Coated | 2 | 0.71 | 0.03 | x |
| Photographic Material-4 (Invention) | Support 6 | Coated | 2 | 0.71 | 0.03 | ∘ |

*The mark ∘ indicates that the film is in a dried form when the film comes out from the processor. The mark x indicates that the film is in an undried from when the film comes out from the processor.

It is clear from Table 1 that a photographic material, which provides a high quality image, exhibits less residual color and is excellent in drying characteristics, can be obtained according to the present invention.

EXAMPLE 2

Preparation of Support 7

A support 7 was prepared in the same manner as in the preparation of the support 4, except that the following dye B was used in place of the dye A.

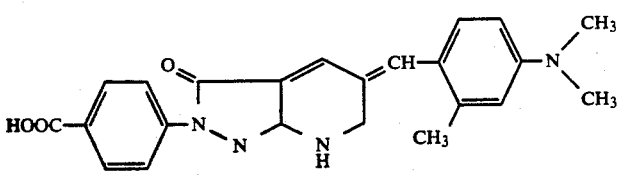

Dye B

Preparation of Support 8

A support 8 was prepared in the same manner as in the preparation of the sample 6, except that the above-described dye B was used in place of the dye A.

Preparation of Dye Solution

Distilled water (434 ml) and a 6.7% solution of 53 g of Triton X-200 surfactant (TX-200) (a product of Rohm & Haas) were placed in a 1.5 liter bottle having a screw cap. 20 g of a dye and 800 ml of zirconium oxide (ZrO) beads having a diameter of 2 mm were added thereto. The cap of the bottle was tightly shut. The bottle was put into a mill and the contents were crushed for 4 days.

The contents were added to a 12.5% aqueous gelatin solution (160 g) and the mixture was placed in a roll mill to reduce bubbles. The resulting mixture was filtered to remove ZrO beads. The mixture, as filtered, had an average particle diameter of about 0.3 μm and was composed of fine particles having a particle size of 0.05 to 0.95 μm. Accordingly, the particles were centrifuged to separate them into particles having a particle size of not larger than 0.3 μm.

The preparation and coating of the emulsion were carried out in the same manner as in Example 1 to prepare photographic materials 5 and 6. Evaluation was made in the same way as in Example 1.

TABLE 2

| Sample | Support Used | Gelatin Interlayer | Cross-over (%) | MTF | Residual Color |
|---|---|---|---|---|---|
| Photographic Material-5 (Comparison) | 7 | Omitted | 2 | 0.71 | 0.10 |
| Photographic Material-6 (Invention) | 8 | Coated | 2 | 0.71 | 0.03 |

It is clear from Table 2 that a photographic material which provides a high quality image and has less residual color can be obtained according to the present invention.

EXAMPLE 3

Preparation of Support 9

A biaxially oriented polyethylene terephthalate film of 100 μm was subjected to a corona discharge treatment and then coated with the following layer in such an amount as to give the following coating weight. The coating was carried out by means of a wire bar coater. The coated film was dried at 170° C. for 1 minute.

First Layer on the Surface Side of the Film

| | |
|---|---|
| Butadiene/Styrene Copolymer Latex (butadiene/styrene ratio = 31/69 by weight) | 0.16 g/m$^2$ |
| Sodium Salt of 2,4-Dichloro-6-hydroxy-s-triazine | 4.2 g/m$^2$ |

-continued

The latex solution contained 0.4 wt % (based on the weight of solid in latex) of the following compound as an emulsifying dispersant.

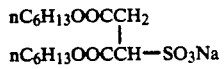

First Layer on the Back Side Thereof

| | |
|---|---|
| Polyacrylic Ester (polymethyl acrylate/ethyl acrylate/methyl methacrylate/dimethylaminoethyl methacrylate) | 28 mg/m$^2$ |
| $SnO_2$/Sb | 170 mg/m$^2$ |

Preparation of Support 10

The support 9 was coated with the following layer in such an amount as to give the following coating weight. The coating was carried out by means of a wire bar coater. The coated support was dried at 170° C. for 1 minute.

Second Layer (dry layer) on the Surface Side

| | |
|---|---|
| Gelatin | 100 mg/m$^2$ |
| 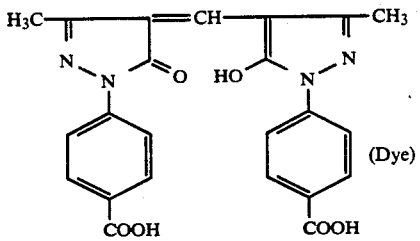 (Dye) | 80 mg/m$^2$ |
| 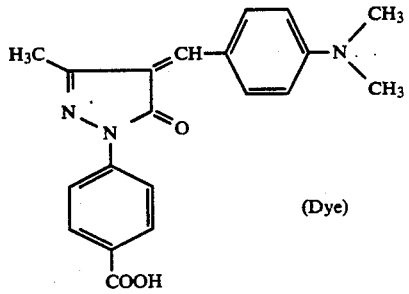 (Dye) | 90 mg/m$^2$ |
| 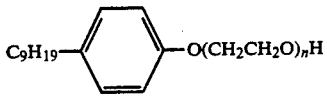 (n = 8.5) | 1 mg/m$^2$ |

-continued

| | |
|---|---|
| Matting Agent (polymethyl methacrylate having an average particle size of 2.5 μm) | 1.36 mg/m$^2$ |
| 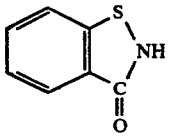 | 1.18 mg/m$^2$ |

Second Layer on the Back Side

| | |
|---|---|
| Polyolefin (ethylene/methacrylic acid copolymer) | 133 mg/m$^2$ |
| Snowtex C (a product of Nissan Chemical Industries, Ltd.) | 66 mg/m$^2$ |

Preparation of Support 11

The support 9 was coated with the following layer in such an amount as to give the following coating weight. The coating was carried out by means of a wire bar coater. The coated support was dried at 170° C. for 1 minute.

Second Layer on the Surface Side

| | |
|---|---|
| Gelatin | 20 mg/m$^2$ |
| 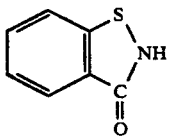 | 0.024 mg/m$^2$ |

The resulting base was coated with the following layer in such an amount as to give the following coating weight. The coating was carried out by means of a wire bar coater. The coated base was dried at 170° C. for 1 minute.

Third Layer (dye layer) on the Surface Side

| | |
|---|---|
| Gelatin | 80 mg/m$^2$ |
| 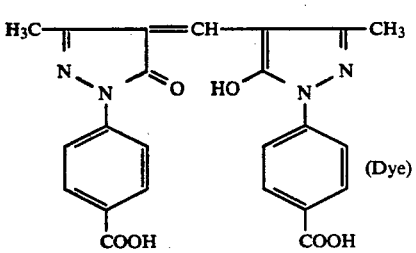 (Dye) | 80 mg/m$^2$ |

-continued

| | |
|---|---|
| 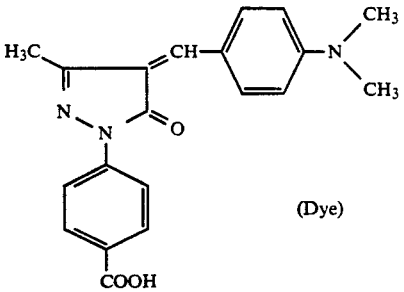 (Dye) | 90 mg/m$^2$ |
| 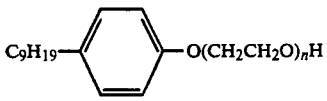 (n = 8.5) | 0.8 mg/m$^2$ |
| Matting Agent (polymethyl methacrylate having an average particle size of 2.5 μm) | 1.36 mg/m$^2$ |
| 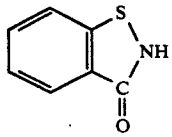 | 0.140 mg/m$^2$ |

Second Layer on the Back Side

| | |
|---|---|
| Polyolefin (ethylene/methacrylic acid copolymer) | 133 mg/m$^2$ |
| Snowtex C | 66 mg/m$^2$ |

PREPARATION OF EMULSION COATING SOLUTION

Solution I (75° C.)

| | |
|---|---|
| Inert Gelatin | 24 g |
| Distilled Water | 900 ml |
| KBr | 4 g |
| 10% Aqueous Solution of Phosphoric Acid | 2 ml |
| Sodium Benzenesulfinate | $5 \times 10^{-2}$ mol |
| 1,2-Bis(2-hydroxyethylthio)ethane | $2.5 \times 10^{-3}$ mol |

Solution II (35° C.)

| | |
|---|---|
| Silver Nitrate | 170 g |
| Distilled Water to make | 1,000 ml |

Solution III (35° C.)

| | |
|---|---|
| KBr | 230 g |
| Distilled Water to make | 1,000 ml |

Solution IV (room temperature)

| | |
|---|---|
| Potassium Hexacyanoferrate(II) | 3.0 mg |

-continued

| | |
|---|---|
| Distilled Water to make | 100 ml |

The solution II and the solution III were simultaneously added to the well stirred solution I over a period of 45 minutes. When the addition of the total amount of the solution II was completed, a cubic monodisperse emulsion having an average particle diameter of 0.28 μm was finally obtained. In the addition of the solutions II and III, the solution III was added at such a rate that the pAg value in the mixing container was kept at 7.50. After 7 minutes from the commencement of the addition of the solution II, the solution IV was added over a period of 5 minutes. After the completion of the addition of the solution, washing with water was conducted, desalting was conducted by a precipitation method and the resulting product was dispersed in an aqueous solution containing 100 g of inert gelatin. To the resulting emulsion, there were added 34 mg of sodium thiosulfate and 34 mg of chloroauric acid, each amount being per mol of silver. The pH was adjusted to 8.9 and the pAg value was adjusted to 7.0 (40° C.). The emulsion was then chemically sensitized at 75° C. for 60 minutes to obtain a surface latent image type silver halide emulsion.

Preparation of Photographic Materials 7 and 8

Each of the supports 10 and 11 was coated with the above-prepared coating solution for emulsion layer to obtain each of photographic materials.

The coating weights of emulsion layer and surface protective layer were as follows.

Emulsion Layer

| | |
|---|---|
| Silver Halide Emulsion (in terms of silver) | 1,700 mg/m² |
| Sensitizing Dye | 23.8 mg/m² |

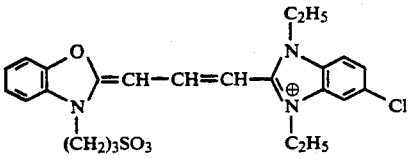

| | |
|---|---|
| 5-Methylbenzotriazole | 4.1 |
| Sodium Dodecylbenzenesulfonate | 5 |
| 1,3-Bis(vinylsulfonyl)-2-propanol | 56 |
| Polysodium Styrenesulfonate | 35 |
| | 15 |

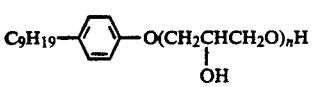

Protective Layer

| | |
|---|---|
| Inert Gelatin | 1,300 mg/m² |
| Colloidal Silica | 249 |
| Liquid Paraffin | 60 |
| Strontium Barium Sulfate (average particle size: 1.5 μm) | 32 |
| Proxel | 4.3 |
| Sodium Dodecylbenzenesulfonate | 4.0 |
| Potassium Salt of N-Perfluorooctanesulfonyl-N-propylglycine | 5.0 |
| 1,3-Bis(vinylsulfonyl)-2-propanol | 56 |

(3) Exposure of Coated Sample (a) Imagewise Exposure

Imagewise exposure was carried out through a continuous density wedge from the emulsion-coated side under safelight for $10^{-3}$ second by using MARK-II xenon flash sensitometer (made by E.G. & G. Co., U.S.A.).

(b) Reversal Development

Reversal development was carried out with commercially available processing solution for reversal development by using a deep tank automatic processor for reversal development (F-10R, manufactured by Allen Products, U.S.A.) under the following conditions.

| | Reversal Development Conditions | | |
|---|---|---|---|
| Stage | Processing Solution | Temperature (°C.) | Time (sec) |
| 1. First Development | FR-531 (1:3)* | 43 | 15 |
| 2. Rinse | Running Water | " | " |
| 3. Bleaching | FR-532 (1:3) | " | " |
| 4. Cleaning | FR-533 (1:3) | " | " |
| 5. Exposure | — | — | — |
| 6. Second Development | FR-534 (1:3) | " | " |
| 7. Fixing | FR-535 (1:3) | " | " |
| 8. Rinse | Spray | " | " |
| 9. Drying | Hot Air | — | — |

*The indicated agent was diluted with water at a weight ratio of 1:3 (hereinafter the same).

(c) Negative Development

Both negative development and direct reversal development were carried out with general purpose processing solution (FR-537 developing solution manufactured by FR Chemicals, U.S.A.) for commercially available microfilms by using deep tank automatic processor (F-10, manufactured by Allen Products, U.S.A.) under the following conditions.

| Stage | Processing Solution | Temperature (°C.) | Time (sec) |
|---|---|---|---|
| 1. Development | FR-537 (1:3) | 43 | 15 |
| 2. Rinse | Running Water | " | " |
| 3. Fixing | FR-535 (1:3) | " | " |
| 4. Rinse | Spray | " | " |
| 5. Drying | Hot Air | — | — |

Measurement for Residual Color

The unexposed film was subjected to the above-described automatic processing. The density of blue color transmitted light was then measured by X-Rite. The density of blue color transmitted light of the polyethylene terephthalate support having no undercoat was measured. A net value obtained by subtracting the resulting value from the above-measured value was referred to as the value of density of residual color. Evaluation was made by the net value.

TABLE 3

| Sample | Support Used | Gelatin Inter-layer | Residual Color in Reversal Development | Residual Color in Negative Development |
|---|---|---|---|---|
| Photographic Material-7 | Support 10 | Omitted | 0.04 | 0.04 |

TABLE 3-continued

| Sample | Support Used | Gelatin Inter-layer | Residual Color in Reversal Development | Residual Color in Negative Development |
|---|---|---|---|---|
| (Comparison) Photographic Material-8 (Invention) | Support 11 | Coated | 0.02 | 0.02 |

It is clear from Table 3 that there can be obtained a photographic material which exhibits less residual color according to the present invention.

EXAMPLE 4

A support 12 was prepared in the same manner as in the preparation of the support 6, except that the amount of sodium salt of 2,4-dichloro-6-hydroxy-s-triazine was 1 mg/m$^2$.

A photographic material 9 was prepared in the same manner as in Example 1, except that the support 12 was used.

Measurement of Swelling Ratio

Measurement was made in the same way as in Example 1.

Method for Measuring Scratch Resistance in the Developing Solution

The temperature of the automatic developing solution of Example 1 was adjusted to 35° C. The photographic materials were immersed therein for 25 seconds. Thereafter, the photographic materials were scratched with a sapphire needle whose tip had a radius of 1.2 mm while continuously changing a load in the range of 0 to 200 g. A load under which the layer was broken was referred to as scratch resistance in the developing solution.

TABLE 4

| Sample | Support Used | Swelling Ratio of Dye Layer (%) | Scratch Resistance in Developing Solution (g) |
|---|---|---|---|
| Photographic Material-9 (Comparison) | Support 12 | 250 | 40 |
| Photographic Material-4 (Invention) | Support 6 | 150 | 85 |

It is clear from Table 4 that a photographic material having a high layer strength in the developing solution can be obtained according to the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support provided with an undercoat layer having thereon at least one silver halide emulsion layer and at least one dye-containing hydrophilic colloid layer between said emulsion layer and said undercoat layer, wherein the dye contained in said dye-containing hydrophilic colloid layer absorbs light in the light-sensitive region of said silver halide emulsion layer and is decolorized during the course of development, said dye-containing hydrophilic colloid layer has a swelling ratio of not higher than 180%; the coating weight of the hydrophilic colloid of said dye-containing hydrophilic colloid layer is not more than 0.5 g/m$^2$; said undercoat layer comprises a hydrophobic polymer, and at least one hydrophilic colloid layer is provided between said dye-containing hydrophilic colloid layer and said undercoat layer.

2. A silver halide photographic material as in claim 1, wherein the coating weight of the hydrophobic polymer of the undercoat layer is 100 to 1,000 mg/m$^2$.

3. A silver halide photographic material as in claim 1, wherein the hydrophobic polymer used in the undercoat layer is selected from styrene-butadiene copolymers, vinylidene chloride copolymers, water-soluble polyesters and polyacrylic esters.

4. A silver halide photographic material as in claim 1, wherein the coating weight of the dye in the dye layer is from 1 to 1,000 mg/m$^2$.

5. A silver halide photographic material as in claim 4, wherein the coating weight of the dye in the dye layer is from 10 to 300 mg/m$^2$.

6. A silver halide photographic material as in claim 1, wherein the coating weight of the hydrophilic colloid in the dye layer is 10 to 500 mg/m$^2$.

7. A silver halide photographic material as in claim 6, wherein the coating weight of the hydrophilic colloid in the dye layer is 10 to 200 mg/m$^2$.

8. A silver halide photographic material as in claim 1, wherein the weight ratio of the dye to the hydrophilic colloid is not less than 0.15.

9. A silver halide photographic material as in claim 8, wherein the weight ratio of the dye to the hydrophilic colloid is not less than 0.5.

10. A silver halide photographic material as in claim 1, wherein the swelling ratio of the dye layer is 100 to 180%.

11. A silver halide photographic material as in claim 10, wherein the swelling ratio of the dye layer is 110 to 170%.

* * * * *